United States Patent [19]

Landen, deceased et al.

[11] 3,944,101

[45] Mar. 16, 1976

[54] SAFETY CLOSURE

[76] Inventors: William James Landen, deceased, late of Cheshire, Conn. by Paulette S. Landen, executrix, 30 Fairwood Drive, Cheshire, Conn. 06410

[22] Filed: Apr. 16, 1974

[21] Appl. No.: 461,450

[52] U.S. Cl. ..... 215/216; 215/218

[51] Int. Cl.[2]. B65D 55/02; B65D 85/56; A61J 1/00

[58] Field of Search ..... 215/9, 216, 218, 221, 330

[56] References Cited

UNITED STATES PATENTS

| | | | |
|---|---|---|---|
| 3,422,978 | 1/1969 | Quackenbush | 215/216 |
| 3,567,057 | 3/1971 | Landen | 215/221 |
| 3,698,584 | 10/1972 | Miller | 215/216 |
| 3,744,655 | 7/1973 | Nixdorff, Jr. | 215/216 |
| 3,830,391 | 8/1974 | Uhlig | 215/9 |

*Primary Examiner*—George T. Hall

*Attorney, Agent, or Firm*—Hopgood, Calimafde, Kalil Blaustein & Lieberman

[57] ABSTRACT

The invention contemplates a safety closure cap having axially compliant connection between two concentric parts, the inner of which has rotatable connection to a bottle neck or the like. The outer concentric part has ratcheting one-way engagement with coacting ratchet means on the bottle, the engaging direction being such as to oppose disengagement of the rotatable connection. Only by performing the extra operation of axially lifting the outer part of the cap, against the stiffness of the compliant connection, can the ratchet engagement be dislodged, to the extent permitting rotated disengagement of the bottle closure.

10 Claims, 8 Drawing Figures

SAFETY CLOSURE

This invention relates to bottles or the like containers adapted to contain hazardous substances, and more particularly relates to safety closures for such containers which render them child-resistant, i.e., resistant to tampering by children.

It is an object of the invention to provide a new and improved safety cap for such a container, particularly of the variety having rotary engagement, as by threads.

Another object of the invention is to provide a new and improved safety cap for a bottle which is economical to manufacture and readily lends itself to automatic production-line facilities for filling and capping a bottle.

A further object of the invention is to provide a new and improved safety cap and bottle combination in which the cap is readily locked onto the bottle but may be unlocked therefrom by a very simple manipulation of the cap itself.

A still further object is to meet the above objects with a construction of inherent low cost, involving minimum alteration of present constructions.

It is also an object to provide the above-noted features in application to molded glass or plastic containers, and involving minimal change in container molds.

Other objects and various further features of novelty and invention will be pointed out or will occur to those skilled in the art from a reading of the following specification in conjunction with the accompanying drawings. In said drawings, which show, for illustrative purposes only, a preferred form of the invention:

Figure 1:
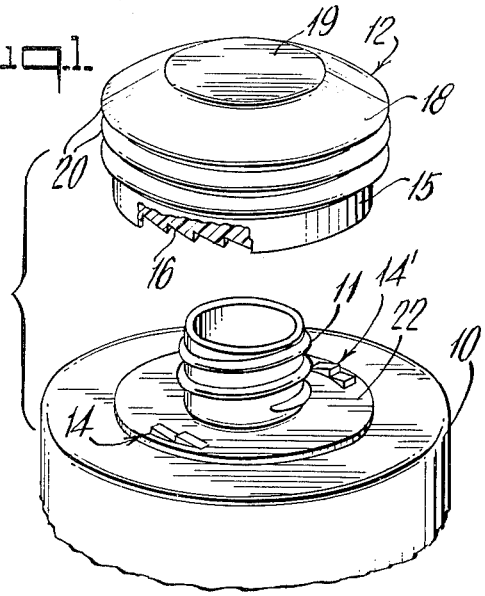
FIG. 1 is an exploded perspective view of cooperating bottle-and-cap elements of the invention.
Figure 2:
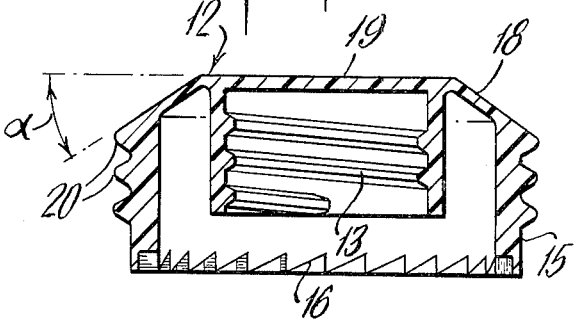
FIG. 2 is an enlarged view in elevation of the cap of FIG. 1, partly broken-away and in section for a better showing of detail.

Referring to FIGS. 1 and 2, the invention is shown in application to a container or bottle 10 having an integral threaded neck 11 and selectively opened and closed by a cap 12 having a threaded bore 13. The bottle may be of any suitable material such as glass, metal or plastic, but is shown in the style of a blow-molded plastic bottle. Cap 12 may be of any suitable construction, being typically an injection-molded plastic part, for the case of a plastic bottle 10.

In accordance with the invention, the neck region of the bottle non-rotatably carries locking-projection means 14, and the cap 12 includes an outer skirt or sleeve portion 15 which (*a*) is equipped with ratchet-tooth formations 16 for coaction with the locking-projection means 14 and (*b*) is axially compliantly and coaxially suspended with respect to an inner skirt or sleeve portion 17 having the threaded bore 13. Thus, in the simple version depicted in FIGS. 1 to 4, there are only two parts, cap 12 and bottle 10.

The two sleeve portions 15–17 are shown with relatively thick and therefore stiff, walls. They are united to each other by a relatively thin frusto-conical annulus 18 which provides the basis for the indicated axial compliance; generally speaking, the dish angle $\alpha$ of this compliant connection will be a function of desired axial stiffness and of the size of the parts, being in the order of 5 to 10 degrees. The inner circular end wall 19 may be of desired thickness and internal contour for sealed relation to the upper end of the bottle neck; no detail is provided for such contour, since it does not pertain to the present invention. Plural axially spaced circumferential ridges 20 characterize the outer wall of the outer sleeve 15 for better finger engagement and application of axial-lifting force, as will later be made clear. The ratchet teeth 16 are preferably formed within the thickness of sleeve portion 15, so as to leave a circumferentially continuous outer wall portion or rim 21 which can smoothly ride a coacting annular rim or land 22 on bottle 10, such land extending slightly radially outside the locking formations or teeth 14.

In the unstressed condition of cap 12, the lower axial end of the threaded inner sleeve 17 is preferably so positioned with respect to the lower axial end of the outer sleeve 15 (all in terms of the axial relation between the threaded and locking regions 11–14 of the bottle) that upon cap placement to the bottle neck, initial rotation will at least commence a threaded engagement of regions 11–13 before a ratchet action commences. Once threads engage, continued rotation is self-piloting on the threads and ratcheting action will commence and continue, as an escapement involving local compliant transient axial deformation of the dished connection 18. At each escape of tooth engagement, the degree of resilient axial load is increased, once the rim 21 begins to ride the land 22; and, by the time that fully threaded engagement and closure are effected, the angle $\alpha$ will have been reduced as a result of the axial-preload action of connection 18. Teeth 14–16 engage in the direction to oppose unthreading rotation of cap 12, and therefore a fully threaded-on cap is locked as long as the ratchet engagement remains.

To remove the cap, one must grasp the finger-engagement region 20 and axially pull sleeve portion 15 out of its ratchet-engaged position. Since such withdrawal is in the direction of greater compliant deformation of connection 18, one must exert a relatively strong withdrawal force to dislodge the ratchet lock and, while maintaining such force, cap 12 should be unthreaded. Once thus removed from the ratchet-locked position, the connection 18 returns to its original unstressed condition, illustrated in both FIGS. 1 and 2.

Now, with certain materials it may suffice to provide merely one tooth 14 upon the bottle 10; in other words, the above-described relationship and action are possible for a situation involving but one tooth 14. For the case of a plastic bottle 10, especially a blow-molded bottle of polyethylene, the use of a single tooth 14 may not be sufficiently strong to permit repeated ratchet engagement and disengagement, as when it is necessary to have many occasions for access to the bottle contents before such contents have been fully consumed. The showing in FIG. 1 at 14 therefore indicates preference for use of plural locking projections or teeth, the same being sized, shaped and positioned to have simultaneous ratchet engagement with two adjacent cap teeth 16 at any given time. And, of course, more enhanced ratchet action may be achieved by providing teeth 14, in duplicate on land 22, at a location 180° offset from the location shown in FIG. 1.

Figure 3:
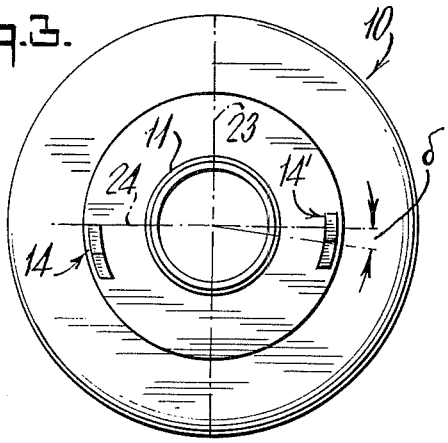
FIG. 3 is a top plan view of a bottle, modified with respect to that of FIG. 1.

FIG. 3 illustrates use of two spaced sets of bottle teeth 14–14′ at angularly spaced locations, approximately 180° apart. Four such teeth are shown at each of these regions 14–14′, but the 180° spacing is modified to the extent of a half-tooth increment δ, as between the teeth of set 14 and those of set 14′. In applying cap 12 to the closure of the bottle of FIG. 3, the ratchet action will be seen to alternate between (a) engagement of teeth 14–16, in interlace with (b) engagement of teeth 14′–16. The net result is to provide twice as many possible ratchet-tooth engageable positions per cap rotation as there are teeth in cap 12.

FIG. 3 also serves to illustrate how teeth 14 may be formed in blow-molding bottle operations, with negligible change in existing procedures. The conventional parting line between mold halves is indicated at 23, approximately as the perpendicular bisector of the diametral line 24 through the central regions of the opposed tooth sets 14–14′. Also, all teeth 14–14′ are shown parallel to line 24, rather than radial to the axis of neck 11. Such tooth sets 14–14′, being of limited arcuate extent and remote from the parting line 23, may thus be the result of only slight change in existing mold halves, all other molding operations remaining the same; and the fact of molding such teeth in the bottle will present no obstacle to the conventional steps of removing mold halves and the bottle from each other. Also, the fact that the teeth of sets 14–14′ are parallel oriented, rather than radial-oriented (as are the cap teeth 16), presents no obstacle to ratchet action, particularly since each condition of ratchet engagement will necessarily involve four adjacent teeth.

Figure 4:
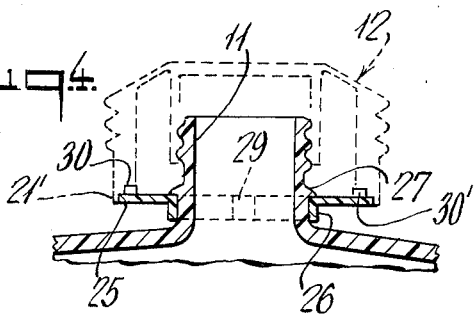
FIG. 4 is a fragmentary sectional view of bottle elements of a modification.
Figure 5:
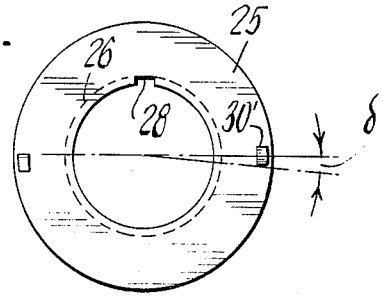
FIGS. 5 and 6 are plan views of a part of FIG. 4, to show alternative forms.

FIGS. 4 and 5 illustrate a modification wherein cap 12 is used to secure a threaded bottle neck 11 and wherein the locking projections on the bottle are defined on a circumferentially continuous ring member 25, which may be a precision injection-molded plastic part assembled to the base end of the neck region 11. Ring 25 is shown with an axial flange or sleeve formation 26 at its bore, for fit to the circumferential groove defined beneath a retaining bead or shoulder 27 on the bottle neck, and a local recess 28 in the bore of ring 25 will be understood to have keyed engagement with a key formation or lug 29 in the bottle neck. Single opposed locking teeth 30–30′ are integrally formed with ring 25, for radial registry with cap teeth 16, and with the half-tooth offset δ described in connection with FIG. 3. It will be understood that if the number of cap teeth 16 is an even number, then the offset δ is with respect to 180°, but that if this is an odd number, the offset δ is achieved by having teeth 30–30′ exactly 180° apart. Ratcheting action is thus interlaced, in the succession of engagements at 30–30′, and some of the compliant action may take place as a deformation of ring 25, from flat to dished condition. Whether or not ring 25 is relied upon for its axial compliance, the fact remains, as with FIGS. 1 to 3, that a sufficiently strong and deliberate axial withdrawal force at 20 is necessary in order to relieve the ratchet lock and thus to permit cap unthreading from the neck 11.

FIG. 4 further illustrates that, if desired, a further circumferentially continuous lip or wall formation 21′ may be provided integral with rim 21, to overlap the periphery of ring 25 and thus prevent prying access to ring 25.

Figure 6:
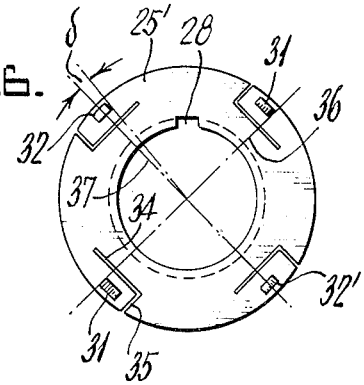

FIG. 6 shows a modified ring 25′ for use in place of ring 25 in FIG. 4. Ring 25′ is again provided with means 28′ for keyed assembly to the bottle neck, but each of a plurality of spaced locking teeth 31–31′, 32–32′ is an integral part of its own spring-arm mounting 33, the latter being also an integral part of ring 25′. Each spring arm 33 is defined by connecting chordal and radial slits 34–35. Teeth 31–31′ are diametrically opposed with respect to a first axis 36, and teeth 32–32′ are diametrically opposed with respect to a quadrature axis 37, except for the half-tooth offset δ already described.

In applying cap 12 to a bottle equipped with ring 25′ of FIG. 6, and assuming an even number of cap teeth 16, each ratchet engagement will involve diametrically opposed locations, 31–31′ in alternation with 32–32′. If the number of cap teeth 16 is odd, then there will be four discrete tooth-engagement locations, for each one-tooth increment of rotation of cap 12; the ring 25′ in such event effectively multiplies by four the number of angles at which cap 12 may be ratchet-locked in place, and this number of lock locations is achieved without any change in the construction of cap 12. In any event, access to the locked container is again had by grasping beads 20 and exerting an axial force adequate to disengage the ratchet, all prior to cap unthreading.

Thus far, all ratchet-locking action has been of the variety which I shall term axial-ratcheting action, meaning that ratchet teeth have ramps which require axial climbing displacement. By contrast, FIGS. 7 and 8 are directed to a form of the invention in which ratchet action is radial, but wherein the dislodgement of ratchet locking again requires application of a sufficient axial withdrawal force.

Figure 7:
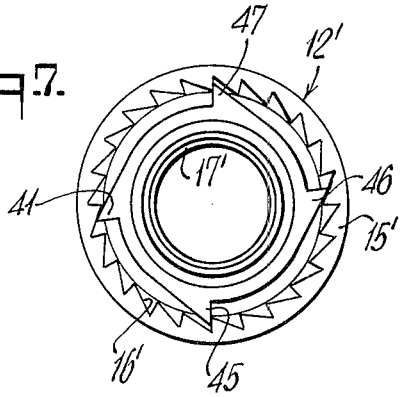
FIG. 7 is a bottom view to show a modified cap.
Figure 8:
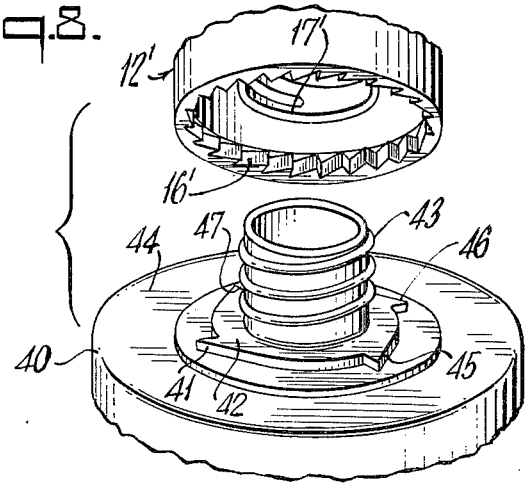
FIG. 8 is an exploded view of a bottle for cooperation with the cap of FIG. 7, the cap being tilted up for a better showing of detail.

The cap 12′ of FIGS. 7 and 8 will be understood to be in all respects the same as described for cap 12, except that the circumferential succession of ratchet teeth 16′ is of constant axial profile, i.e., all tooth ramps can be climbed only by a radial reacting displacement. For engagement with teeth 16′, the bottle 40 has one or more spaced radially directed locking projections or teeth 41, characterizing a generally circular base 42, beneath the threaded region of the neck 43. Since the base 42 is solid and relatively unyielding, reliance is placed upon slight local radial deformation of the outer-sleeve portion 15′ of cap 12′, for each escaping ratchet action. In the use of a single such tooth 41, cap application is preferably initially with a threaded engagement, free of ratchet action. Continued threaded advance of the cap introduces ratchet escapement, and the axial disposition of threads and axial limits of sleeve portions (15′–17′) is preferably such that at least some axially compliant deformation of the compliant annulus 18 occurs by reason of cap interference (at sleeve portion 15′ and the top end wall 44 of the bottle) before threaded closure is complete. The axial force necessary to remove the ratchet engagement must thus first overcome the securing preload and then sufficiently further deflect the connection 18, to the extent of the locking-tooth height H, all prior to any unthreading rotation.

FIGS. 7 and 8 further illustrate that the interlaced multiple-tooth ratchet action described for FIGS. 3 to 6 is also achievable in a radial-action ratchet. For example, tooth 41 may be one of a plurality, additionally shown as 45–46–47. The teeth 41–46 may be diametrically opposed on an axis in quadrature relation to the axis of opposition of teeth 45–47, wherein these axes are again characterized by the half-tooth offset δ, already described. If, then, the number of cap teeth 16' is even, ratchet action will be characterized by a transient first-diameter expansion of sleeve portion 15', in interlaced succession with a transient second-diameter expansion of sleeve portion 15', such expansions being in quadrature relation. If the number of cap teeth 16' is odd, then the described four ratchet engagements per single-tooth rotational advance will occur.

It will be seen that I have described an improved safety construction meeting all stated objects. Of particular importance is the fact that the described action may be achieved without requiring additional parts or molding techniques. Mold changes in the bottle formations are minimal, and are applicable for glass or plastic bottles.

While the invention has been described in detail for the preferred forms shown, it will be under stood that modifications may be made without departure from the claimed invention.

What is claimed is:

1. In combination, a bottle or the like having a threaded neck, and a safety cap having a threaded bore to removably engage said neck, said safety cap having an upper closed end with radially spaced concentric tubular bodies dependent therefrom, said threaded bore being in the inner tubular body and the end closure between said bodies being axially compliant, said axially compliant end closure comprising a relatively thin downwardly and radially outwardly sloped frustoconical member integrally connecting the upper ends of both said concentric bodies, coacting ratchet-tooth formations including a circumferential succession of like equally spaced teeth at the lower end of said outer tubular member and at least two spaced teeth on said bottle or the like at the neck region of adjacency to the tooth formations of said cap when in secured position, said last defined spaced teeth being spaced by an amount which comprehends the spacing of a given plurality of teeth of said cap plus a fraction of the intertooth spacing of said cap, said fraction being substantially the reciprocal of the number of teeth on said bottle or the like, said ratchet formations being one-way engageable in the unthreading direction of cap rotation and escaping in the thread-advancing direction of cap rotation, the axial extent of compliant axial displacement of said concentric members exceeding the axial range over which ratchet action is realized, and the axial location of said threaded and ratchet regions of said cap and bottle or the like being such that said ratchet formations coact over at least the part of the axial range of threaded engagement at which full threaded engagement of said cap and bottle or the like is achieved, the outer wall of said outer tubular member circumferentially continuously surrounding all ratchet-tooth formations of said outer tubular member, whereby said formations are only axially downwardly exposed and therefore are concealed by the outer wall surface of said outer tubular member when said cap is secured to said neck.

2. The combination of claim 1, in which the number of spaced teeth on said bottle or the like is two and said fraction is substantially one half.

3. The article of claim 1, in which the outer contour of said outer body includes circumferentially extending rib means for enhanced manually applied axial force to overcome the axial preload of said compliant end closure when said cap is in ratchet-held threaded engagement with said neck.

4. The combination of claim 1, in which said ratchet formations are characterized by axially directed ratchet action.

5. The combination of claim 1, in which said ratchet formations are characterized by radially directed ratchet action involving a radially compliant region of said outer tubular body.

6. The combination of claim 2, in which said last-defined spaced teeth are substantially 180° opposed and the number of teeth of said cap is an odd number.

7. The combination of claim 1, in which said coacting ratchet formation on said bottle or the like comprises four spaced teeth at equal angular spacing, the number of cap teeth being twice an odd integer number, and the direction of ratcheting action being radial.

8. The combination of claim 1, in which said cap is a single piece of injection-molded plastic material.

9. The combination of claim 1, in which said bottle or the like is a single piece of molded plastic material integrally including said thread and ratchet formations.

10. The combination of claim 1, in which said bottle or the like is a single piece of molded plastic material integrally including the thread formation thereof, and in which the ratchet formation of said bottle or the like is part of a separate ring member having keyed engagement to the neck region of said bottle or the like.

* * * * *